US011221579B2

(12) United States Patent
Robles Flores et al.

(10) Patent No.: US 11,221,579 B2
(45) Date of Patent: Jan. 11, 2022

(54) SYSTEM, APPARATUS, AND METHOD FOR PRINTING LARGE FORMAT MEDIA AND TARGETED DECURLING OF VARIOUS PRINTING PROCESSES

(71) Applicant: Xerox Corporation, Norwalk, CT (US)

(72) Inventors: Eliud Robles Flores, Rochester, NY (US); James A. Spence, Honeoye Falls, NY (US); William G. Osbourne, Fairport, NY (US); Dragana Pavlovic, Rochester, NY (US); Michael J. Martin, Hamlin, NY (US); David C. Craig, Pittsford, NY (US); Roberto A. Irizarry, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 476 days.

(21) Appl. No.: 16/180,713

(22) Filed: Nov. 5, 2018

(65) Prior Publication Data

US 2020/0142341 A1 May 7, 2020

(51) Int. Cl.
*G03G 15/00* (2006.01)

(52) U.S. Cl.
CPC ..... *G03G 15/6576* (2013.01)

(58) Field of Classification Search
CPC ..... G03G 15/6576
See application file for complete search history.

(56) References Cited

U.S. PATENT DOCUMENTS 5,519,481 A 5/1996 Kuo
5,848,347 A 12/1998 Kuo et al.
6,002,913 A 12/1999 Pawlik et al.
6,259,888 B1 * 7/2001 Kazama ..... B65H 29/12 271/183
6,668,155 B1 * 12/2003 Hubble, III ..... G03G 15/6576 162/197
7,424,246 B2 9/2008 Spence et al.
7,437,120 B2 10/2008 Ruthenberg et al.
7,809,323 B2 10/2010 Johnston et al.
8,795,571 B2 * 8/2014 Bryl ..... B65H 23/34 264/280

(Continued)

OTHER PUBLICATIONS

U.S. Appl. No. 16/180,762, filed Nov. 5, 2018.
U.S. Appl. No. 16/180,813, filed Nov. 5, 2018.

*Primary Examiner* — David H Banh

(74) *Attorney, Agent, or Firm* — Simpson & Simpson, PLLC; Michael Nicholas Vranjes

(57) ABSTRACT

A printer for producing a print media moving in a process direction including a print engine, a fuser, a full width array and a duplexing path. The print engine is operatively arranged to receive the print media and to apply a first dry marking material to a first surface of the print media. The fuser is arranged subsequently to the print engine in the process direction and is operatively arranged to receive the print media with the first dry marking material applied to the first surface of the print media and to fix the first dry marking material on the first surface using at least one of heat and pressure. The full width array is arranged subsequently to the fuser and is operatively arranged to obtain a first image of the first surface of the print media, the first image being used to quantify a flatness of the print media and/or image quality of the first image. The duplexing path is arranged subsequently to the full width array.

33 Claims, 7 Drawing Sheets

(56) References Cited

U.S. PATENT DOCUMENTS

| | | | | |
|---|---|---|---|---|
| 9,710,203 | B2 | 7/2017 | Van Acquoij | |
| 2010/0067966 | A1* | 3/2010 | Bober | G03G 15/238 399/397 |
| 2011/0211890 | A1* | 9/2011 | Shigeno | B41J 11/0005 399/406 |
| 2011/0267632 | A1* | 11/2011 | Wu | B41J 2/2135 358/1.9 |
| 2013/0258364 | A1* | 10/2013 | Ito | H04N 1/603 358/1.9 |
| 2013/0258420 | A1* | 10/2013 | Nakaie | H04N 1/02855 358/474 |
| 2015/0262045 | A1* | 9/2015 | Arai | G06K 15/128 358/1.2 |
| 2015/0264190 | A1* | 9/2015 | Arai | H04N 1/4092 358/1.15 |
| 2016/0103633 | A1 | 4/2016 | Huijbers et al. | |
| 2017/0225498 | A1 | 8/2017 | Van Acquoij et al. | |

* cited by examiner

SYSTEM, APPARATUS, AND METHOD FOR PRINTING LARGE FORMAT MEDIA AND TARGETED DECURLING OF VARIOUS PRINTING PROCESSES

FIELD

The disclosure relates to printing systems, in particular to printing systems arranged to print large format media. The disclosure also relates to image processing, more particularly to image processing as it relates to decurling of print media, and, even more specifically, to a system, apparatus, and method for targeted decurling of print media.

BACKGROUND

Known printing systems are limited to forming images and text on print media at or below specific process direction lengths. The foregoing system limitation is caused by a variety of factors; however, heretofore, known systems have not been able to print on media greater than approximately fifty-two inches (52").

Print media, e.g., paper, is typically made by pressing various combinations of moist fibers together and drying them into flexible sheets. The fibers are often obtained from cellulose pulp derived from wood, rags, or grasses. When pressed together, the cellulose fibers overlap forming a substantially homogenous sheet, which is then heated to remove natural moisture from the fibers. As a result of using fibrous cellulose as the base material, paper is highly susceptible to changes in moisture content. During xerographic printing processes, heat is applied to the print media causing a loss in overall moisture content, while during inkjet printing processes, aqueous and solvent based inks are applied to the surface of print media and cured with a radiant energy source, e.g., an ultra-violet or infrared lamp. Additionally, as most of these printing processes result in images being applied that rarely extend to the edges of the print media, there is typically an uneven discrepancy between the moisture content at the edges of the print media and the moisture content at the center of the print media. Furthermore, changes in environmental humidity and variations in thickness of the print media further contribute to undesirable changes in the moisture content of the print media.

Changes in overall moisture content and uneven moisture content between the center of the print media and the edges of the print media can lead to a phenomenon called curling. Curling refers to the angular displacement of the corners of a sheet of print media with respect to the planar surface of that sheet of print media. Curling of the corners of the print media can lead to paper jams, uneven stacking and finishing in the commercial printing environment, as well as other printing issues.

Some previous methods for compensating for curling include running the processed print media through a decurler. A decurler typically includes at least one set of rollers that will apply a physical force to the print media to induce a curl in the opposite direction of the curl induced through known printing processes. However, the induced curl must be estimated and set prior to processing a print job and such induced curl is determined based on the average expected curl. This method is based on a statistical average curl and is not based on individual sheets of print media. Thus, conventional decurlers may result in flattened print media, or alternatively could result in print media having corners that are curled up or curled down depending on the combination of media, machine and environmental conditions.

Known decurler algorithms do not account for toner location when attempting to remove curl induced in the xerographic process, nor do they account for ink location when attempting to remove curl induced in the ink printing process. Experimentation with white toner has shown that the location where toner material gets deposited, significantly affects the level of curl observed in the media. It is believed that this result can be explained by a much higher Developer Mass per Area (DMA) for white toner (1.3 $mg/cm^2$) compared to CMYK (average of 0.45 $mg/cm^2$) Moreover, it has been found that toner located on the edges of the print media appears to induce more curl than toner near the center of the sheet. Thus, it is believed that the location of toner or ink deposition should be taken into account when determining how much curler must be removed and where that curl is located.

Thus, there is a need for a system, apparatus, and method for targeted decurling of individual sheets during printing processes based on per pixel image content.

SUMMARY

The present apparatus includes a full width array having red, green and blue (RGB) capabilities which allows imagining of simplex and duplex sheets after the fusing process. The present disclosure proposes using a full width array sensor on a fuser or fixation module to measure toner pixel count and locations throughout the sheet. The full width array sensor may comprise a linear charge coupled device (CCD) that is able to capture thin slices of a sheet of print media in the cross-process direction which are combined to create one single image of the full sheet. An advantage of the present apparatus is the full width array sensor is located just before the upper duplex turn which allows imaging of simplex and duplex sheets using a single sensor array.

Moreover, the present apparatus may be used to detect defects on printed images, may be used to detect missing ink jets, and may be used to measure image on paper registration (TOP).

According to aspects illustrated herein, there is provided a printer for producing a print media moving in a process direction including a print engine, a fuser, a full width array and a duplexing path. The print engine is operatively arranged to receive the print media and to apply a first dry marking material to a first surface of the print media. The fuser is arranged subsequently to the print engine in the process direction and is operatively arranged to receive the print media with the first dry marking material applied to the first surface of the print media and to fix the first dry marking material on the first surface using at least one of heat and pressure. The full width array is arranged subsequently to the fuser and is operatively arranged to obtain a first image of the first surface of the print media, the first image being used to quantify a flatness of the print media and/or image quality of the first image. The duplexing path is arranged subsequently to the full width array.

According to aspects illustrated herein, there is provided a printer for producing a print media moving in a process direction including a print engine, a dryer, a full width array and a duplexing path. The print engine is operatively arranged to receive the print media and to apply a first liquid marking material to a first surface of the print media. The dryer is arranged subsequently to the print engine in the process direction and is operatively arranged to receive the print media with the first liquid marking material applied to the first surface of the print media and to fix the first liquid marking material on the first surface using at least one of heat and pressure. The full width array is arranged subsequently to the dryer and is operatively arranged to obtain a first image of the first surface of the print media, the first image being used to quantify a flatness of the print media and/or image quality of the first image. The duplexing path is arranged subsequently to the full width array According to aspects illustrated herein, there is provided a printer for producing a print media moving in a process direction including a print engine, a fuser, a full width array and a decurling module. The print engine is operatively arranged to receive the print media and to apply a first dry marking material to a first surface of the print media. The fuser is arranged subsequently to the print engine in the process direction and is operatively arranged to receive the print media with the first dry marking material applied to the first surface of the print media and to fix the first dry marking material on the first surface using at least one of heat and pressure. The full width array is arranged subsequently to the fuser and operatively arranged to obtain a first image of the first surface of the print media, the first image being used to quantify a flatness of the print media. The decurling module includes a first roller, a second roller arranged opposite the first roller, and a first actuator. The first actuator imparts a first force on the first roller in a first direction towards the second roller when the first image indicates a first curl in the first direction, and a magnitude of the first force is determined based on the flatness of the print media.

According to aspects illustrated herein, there is provided a printer for producing a print media moving in a process direction including a print engine, a dryer, a full width array and a decurling module. The print engine is operatively arranged to receive the print media and to apply a first liquid marking material to a first surface of the print media. The dryer is arranged subsequently to the print engine in the process direction and is operatively arranged to receive the print media with the first liquid marking material applied to the first surface of the print media and to fix the first liquid marking material on the first surface using at least one of heat and pressure. The full width array is arranged subsequently to the dryer and operatively arranged to obtain a first image of the first surface of the print media, the first image being used to quantify a flatness of the print media. The decurling module includes a first roller, a second roller arranged opposite the first roller, and a first actuator. The first actuator imparts a first force on the first roller in a first direction towards the second roller when the first image indicates a first curl in the first direction, and a magnitude of the first force is determined based on the flatness of the print media.

According to aspects illustrated herein, there is provided a method for decurling a print media including: applying a first material on a first surface of a print media; obtaining a first image of the first surface of the print media using a full width array; analyzing on a pixel-by-pixel basis the first image to determine a magnitude of a first curl in a first direction of the print media; and, applying a first force in the first direction via a first actuator to a first roller proportional to the magnitude of the first curl.

These and other objects, features, and advantages of the present disclosure will become readily apparent upon a review of the following detailed description of the disclosure, in view of the drawings and appended claims.

BRIEF DESCRIPTION OF THE SEVERAL VIEWS OF THE DRAWINGS

Various embodiments are disclosed, by way of example only, with reference to the accompanying schematic drawings in which corresponding reference symbols indicate corresponding parts, in which.

DETAILED DESCRIPTION

Figure 1:
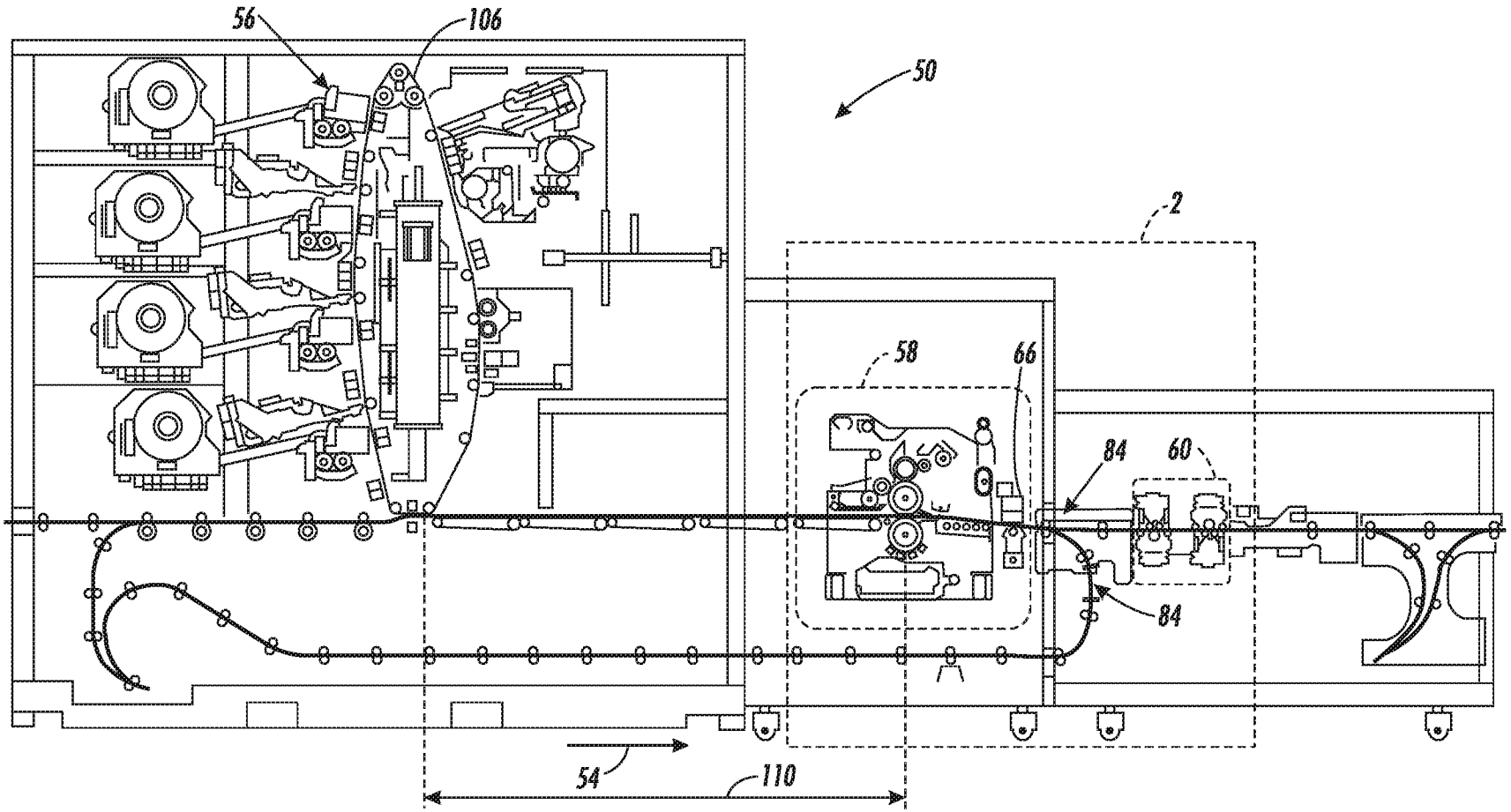
FIG. 1 is a side elevational view of a schematic representation of an embodiment of a present printing system.
Figure 2:
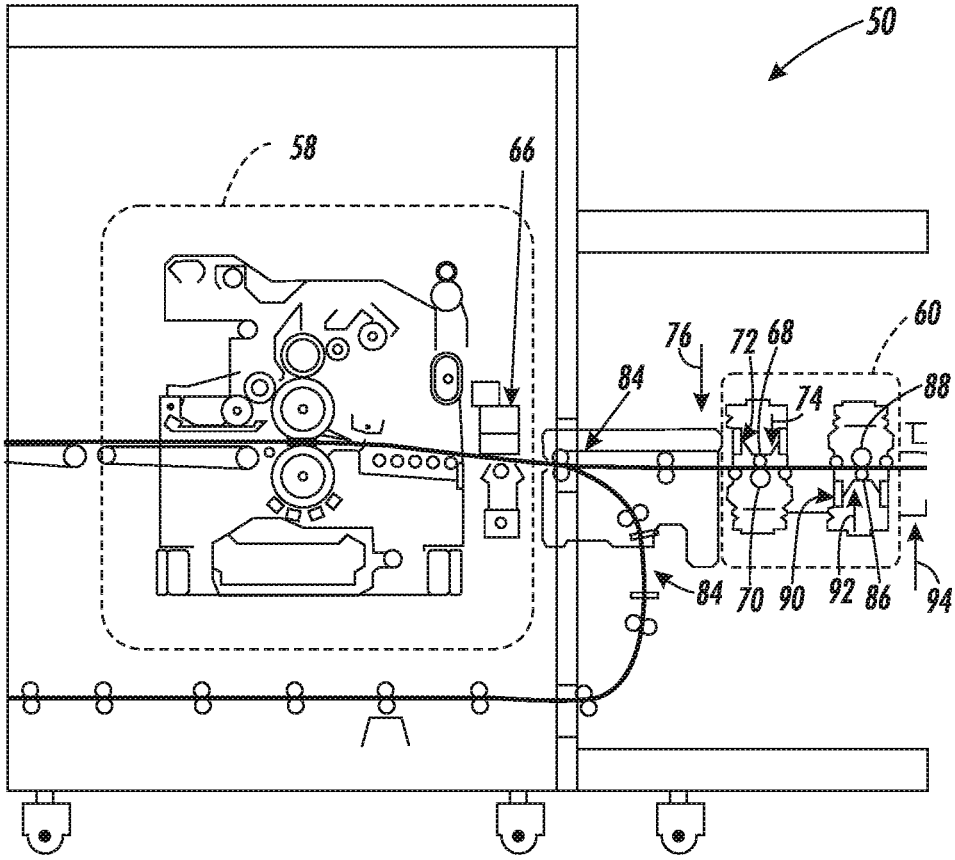
FIG. 2 is an enlarged side elevational view of the encircled region 2 depicted in FIG. 1.
Figure 3:
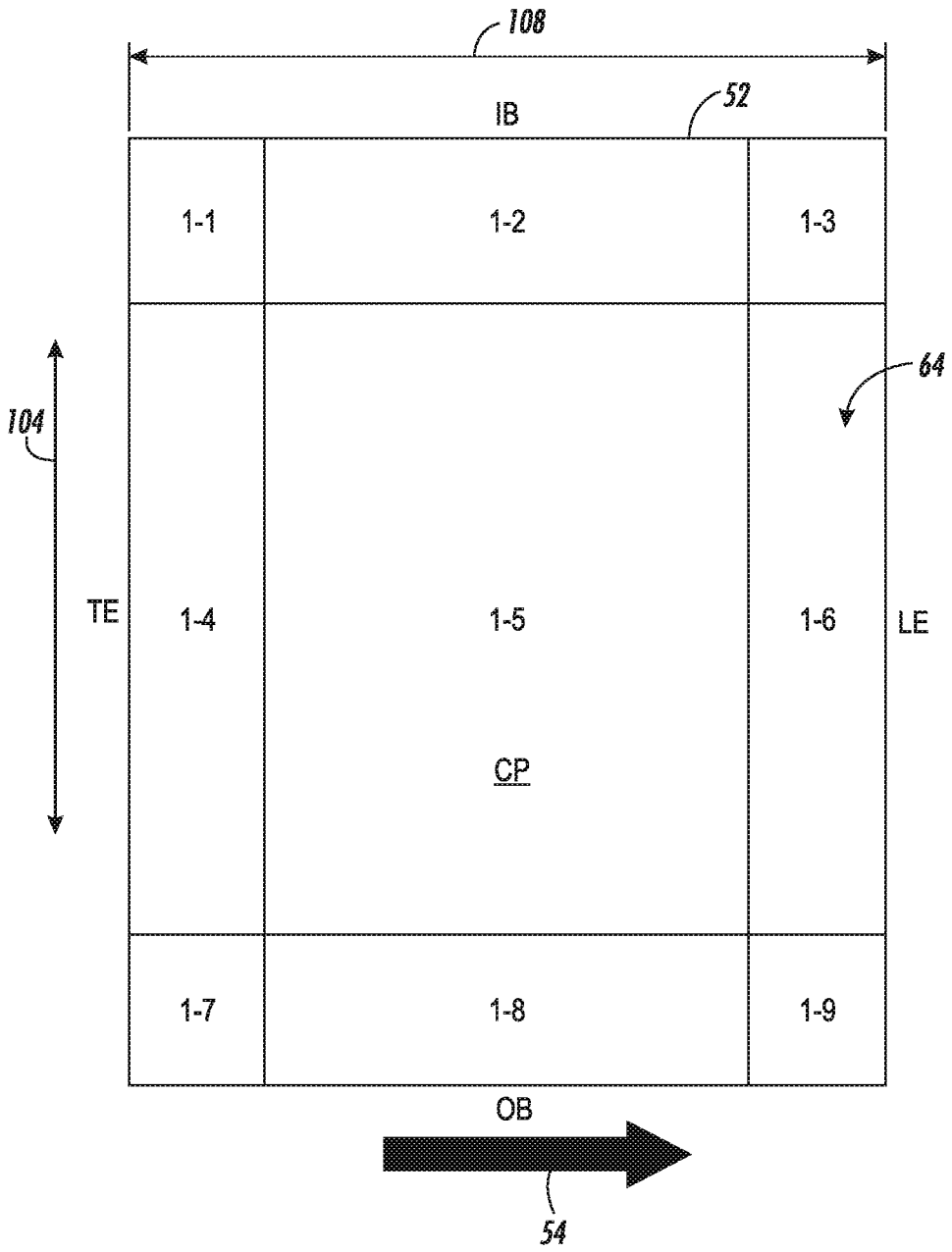
FIG. 3 is top plan view of an embodiment of a sheet of print media used in the present printing system.
Figure 4:
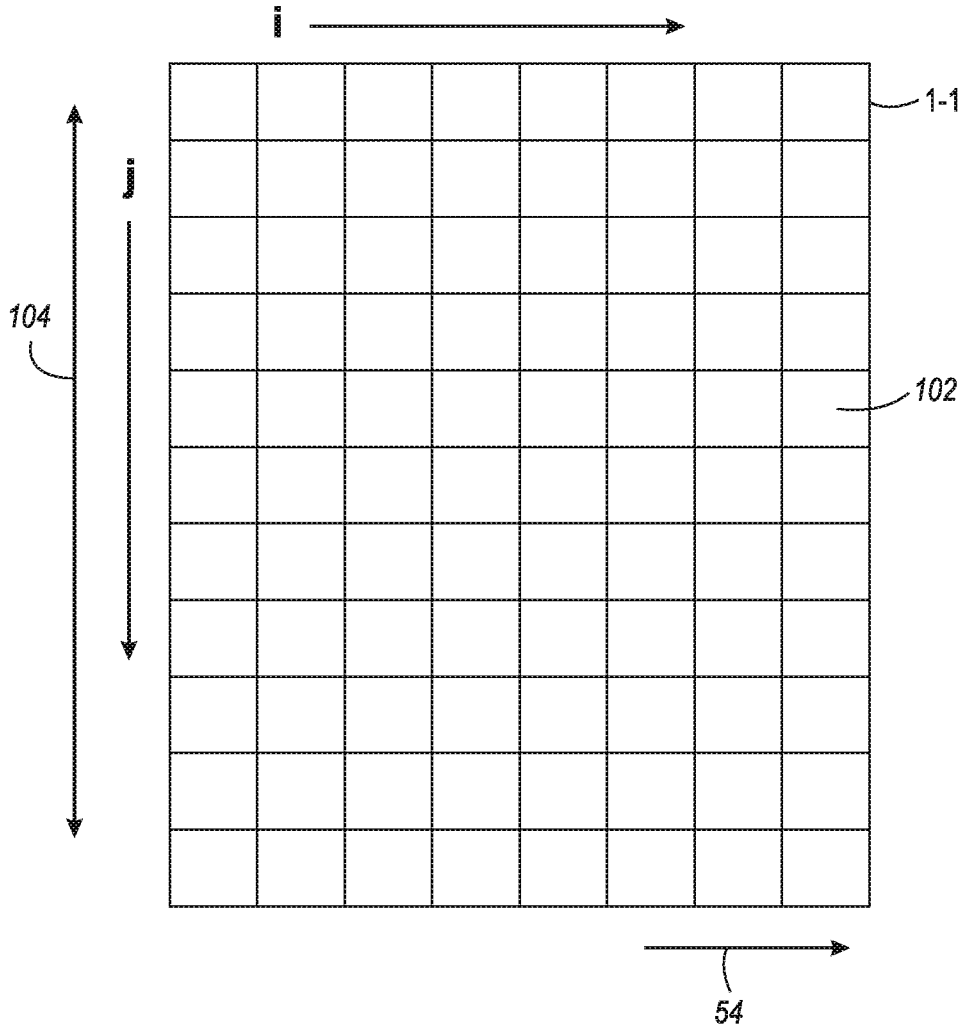
FIG. 4 is an enlarged top plan view of region 1-1 depicted in FIG. 3.
Figure 5:
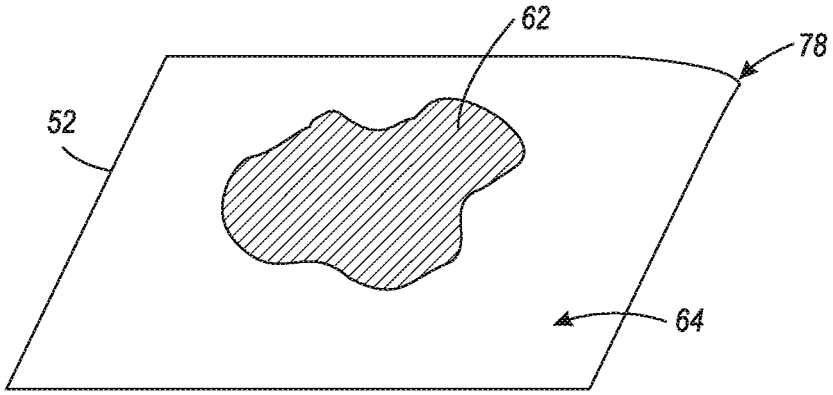
FIG. 5 a perspective view of an embodiment of a first surface of a sheet of print media used in the present printing system.
Figure 6:
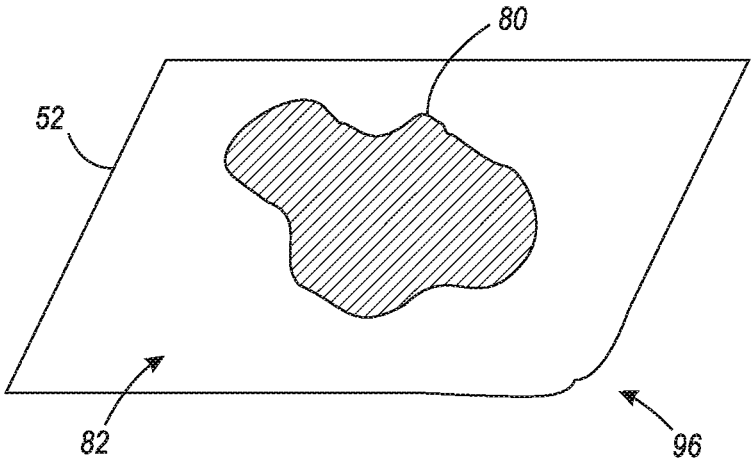
FIG. 6 is a perspective view of an embodiment of a second surface of a sheet of print media used in the present printing system.
Figure 7:
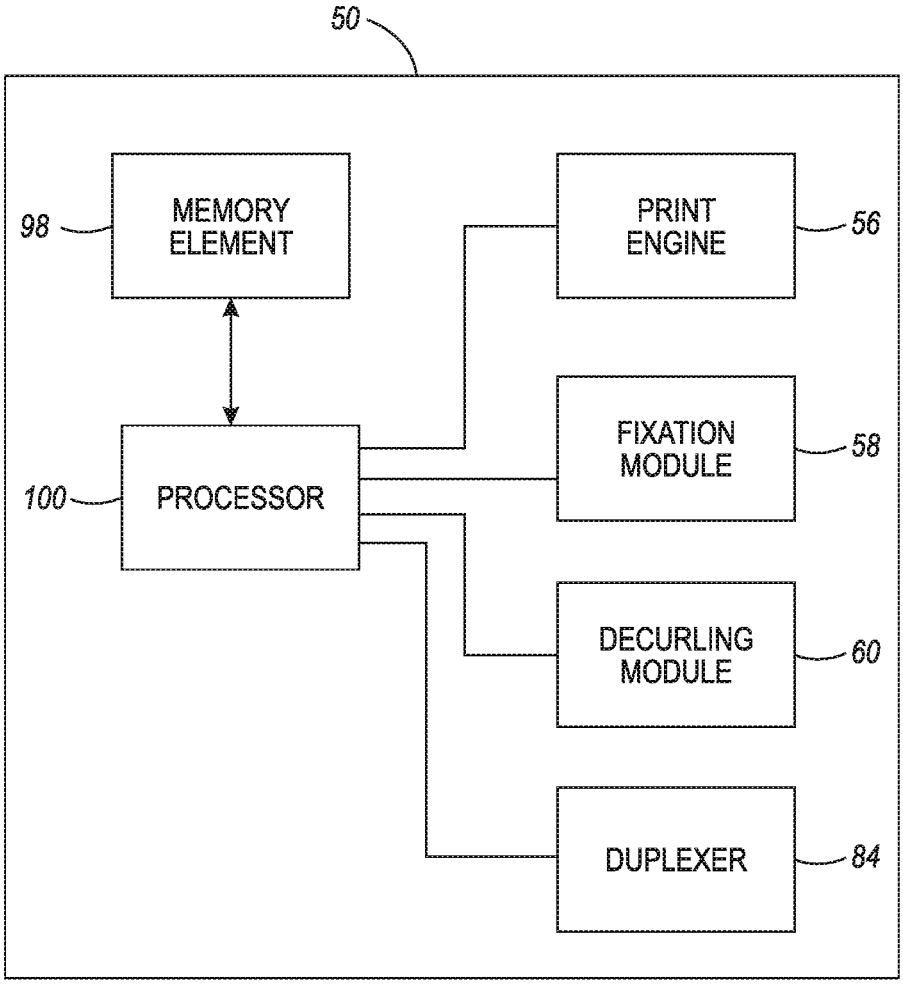
FIG. 7 is a schematic view of an embodiment of a present printing system; and, FIG. 8 is a side elevational view of a schematic representation of an embodiment of a present printing system.
Figure 8:
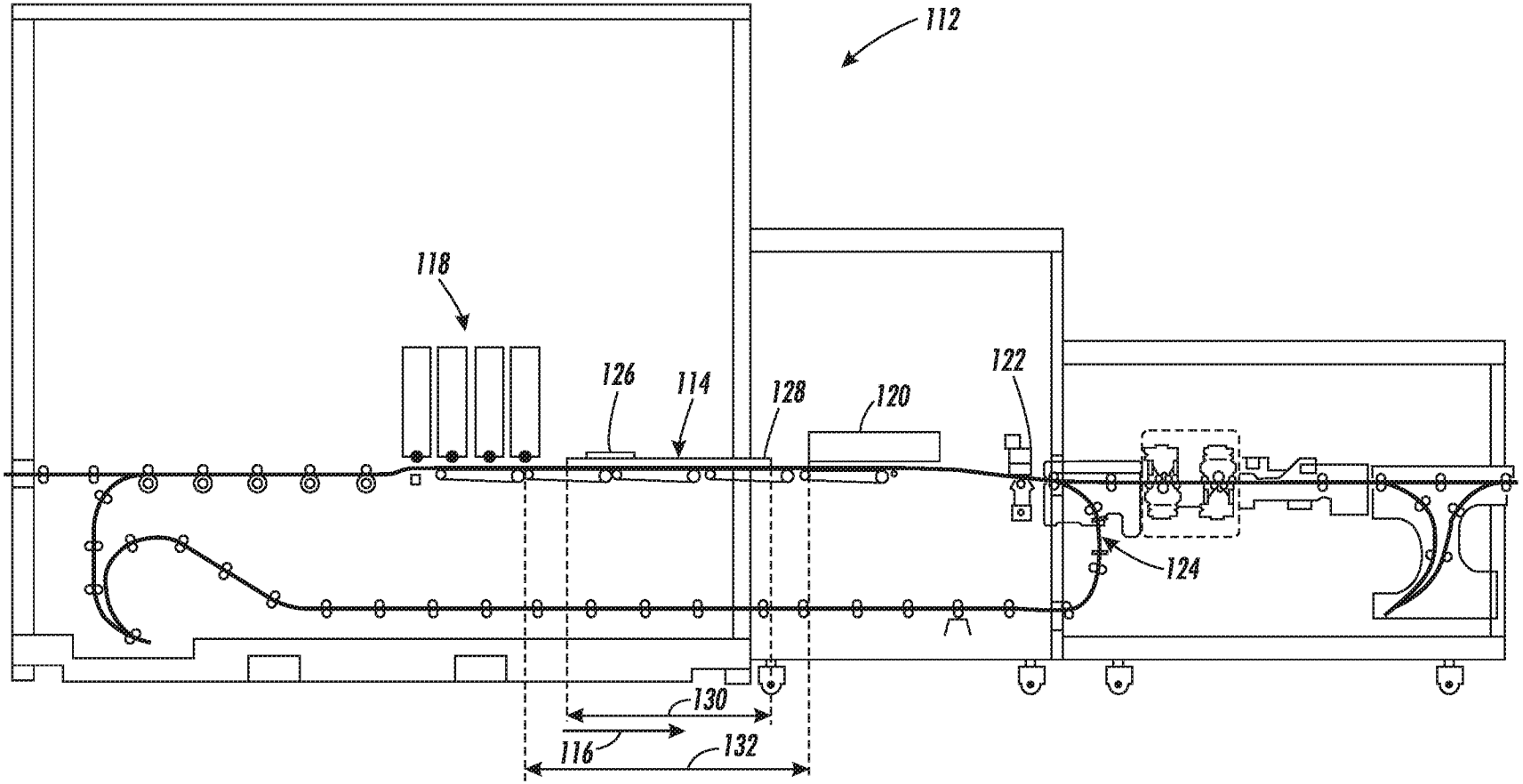

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodologies, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, and/or pneumatics. It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

"Process direction", as used herein, is intended to mean the direction print media travels through the system, while "cross-process direction" is intended to mean the direction perpendicular to the process direction. As used herein, "full width", e.g., "full width array sensor" and "full width printhead array", is intended to be broadly construed as any structure that covers a significant width of the substrate. A "full width array sensor" comprises at least one linear array of photosensors, arranged perpendicular to the process direction and capable of capturing/recording image data at a size relevant to the control system. For example, in some embodiments, the length of a full width array sensor is approximately half of the width of the substrate which it inspects. Furthermore, the words "printer," "printer system", "printing system", "printer device" and "printing device" as used herein encompass any apparatus, such as a digital copier, bookmaking machine, facsimile machine, multi-function machine, etc. which performs a print outputting function for any purpose. Additionally, as used herein, "web", "substrate", "printable substrate" refer to, for example, paper, transparencies, parchment, film, fabric, plastic, photo-finishing papers or other coated or non-coated substrate media in the form of a web upon which information or markings can be visualized and/or reproduced. As used herein, the term 'average' shall be construed broadly to include any calculation in which a result datum or decision is obtained based on a plurality of input data, which can include but is not limited to, weighted averages, yes or no decisions based on rolling inputs, etc.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

As used herein, "fusing," with respect to dry marking material such as toner, is intended to mean supplying heat energy and/or pressure, having the effect of slightly liquifying the applied dry marking material (toner) particles, in turn causing them to adhere to a surface. "Drying," as used herein, is intended to mean applying energy, typically but not necessarily heat in radiant and/or convective form, having the effect of causing a liquid component of the ink (a liquid marking material) to evaporate. "Curing," as used herein, for example with respect to IR inks (liquid marking material) is intended to mean applying energy, such as by typically but not necessarily infrared waves, having the effect of causing a chemical reaction within at least one component of the applied ink, thereby fixing the ink to a surface.

Broadly, in some embodiments, system 50 is adapted to decurl a print media, e.g., paper 52, as the print media moves in process direction 54. System 50 comprises print engine 56, fixation module 58 and decurling module 60. Print engine 56 is operatively arranged to receive print media 52 and to apply a first material, e.g., toner 62, to first surface 64 of print media 52. Fixation module 58 is arranged subsequently to print engine 56 in process direction 54 and operatively arranged to receive print media 52 with first material 62 applied to first surface 64 of print media 52. Fixation module 58 comprises full width array 66 arranged to obtain a first image of first surface 64 of print media 52. The first image is used to quantify a flatness of print media 52. Decurling module 60 comprises first roller 68, second roller 70 arranged opposite first roller 68 and first actuator 72. First actuator 72 imparts first force 74 on first roller 68 in a first direction depicted as unidirectional arrow 76 towards second roller 70 when the first image indicates first curl 78 in first direction 76. A magnitude of first force 74 is determined based on the flatness of print media 52. It should be appreciated that although fixation module 64 is depicted and described as a conventional fuser module typically used in xerographic processes, other fixation modules may also be used for other types of printing processes, e.g., a radiant heat source used to dry ink during ink based printing.

In some embodiments, the magnitude of first force 74 is determined by a pixel-by-pixel analysis of the first image. An example embodiment of a pixel-by-pixel analysis is described herebelow.

In some embodiments, print engine 56 is operatively arranged to apply a second material, e.g., toner 80, to second surface 82 of print media 52 opposite first surface 64 subsequent to fixing first material 62 to first surface 64 of print media 52.

In some embodiments, system 50 further comprises duplexing path 84 arranged subsequently to fixation module 58 and before decurling module 60.

In some embodiments, fixation module 58 is arranged to receive print media 52 with second material 80 applied to second surface 82 of print media 52 opposite first surface 64.

In some embodiments, full width array 66 is operatively arranged to obtain a second image of second surface 82 of print media 52 opposite first surface 64.

In some embodiments, decurling module 60 further comprises third roller 86, fourth roller 88 arranged opposite third roller 86, and second actuator 90. Second actuator 90 imparts second force 92 on third roller 86 in a second direction opposite first direction 76 and towards fourth roller 88, i.e., the direction depicted by unidirectional arrow 94, when the first image and/or the second image indicates second curl 96 in second direction 94. A magnitude of second force 92 is determined based on the flatness of print media 52. In some embodiments, the magnitude of second force 92 is determined by a pixel-by-pixel analysis of the first image and/or the second image, as described above relative to a pixel-by-pixel analysis of the first image alone.

In some embodiments, system 50 further comprises memory element 98 and processor 100. Memory element 98 is arranged to store a set of non-transitory computer executable instructions, the first image, and, if applicable, the second image. Processor 100 is operatively arranged to execute the set of non-transitory computer executable instructions. The set of non-transitory computer executable instructions comprises general operational instructions, e.g., scanning an image, printing an image, etc., and further comprises an algorithm for a pixel-by-pixel analysis of the first image and/or the second image. It should be appreciated that the algorithm for a pixel-by-pixel analysis of one or more images described in greater detail below is only one possible embodiment of an algorithm, and other embodiments are also possible. For example, the images may be analyzed without using the zone approach described below.

Broadly, in some embodiments, apparatus 50 for decurling print media 52 moving in process direction 54 comprises full width array 66, first roller 68, second roller 70, first actuator 72, third roller 86, fourth roller 88, and second actuator 90. Full width array 66 is arranged to obtain a first image from first surface 64 of print media 52 and a second image from second surface 82 of print media 52. First roller 68 is arranged subsequently to full width array 66 in process direction 54, while second roller 70 is arranged subsequently to full width array 66 in process direction 54 and arranged opposite first roller 68. First actuator 72 is arranged to impart first force 74 on first roller 68 in first direction 76, i.e., the direction depicted by unidirectional arrow 76. Third roller 86 is arranged subsequently to first roller 68 and second roller 70 in process direction 54, while fourth roller 88 is arranged subsequently to first roller 68 and second roller 70 in process direction 54 and arranged opposite third roller 86. Second actuator 90 is arranged to impart second force 92 on third roller 86 in second direction 94 opposite first direction 76, i.e., the direction depicted by unidirectional arrow 94. First force 74 is applied via first actuator 72 to first roller 68 in first direction 76 when the first image indicates first curl 78 of print media 52 in first direction 76, and/or second force 92 is applied via second actuator 90 to third roller 86 in second direction 94 opposite first direction 76 when the second image indicates second curl 96 of print media 52 in second direction 94. A magnitude of first force 74 and a magnitude of second force 92 are determined based on a pixel-by-pixel analysis of the first image and the second image, respectively.

As described above, in some embodiments, apparatus 50 further comprises memory element 98 and processor 100. Memory element 98 is arranged to store a set of non-transitory computer executable instructions, the first image, and the second image. Processor 100 is operatively arranged to execute the set of non-transitory computer executable instructions. The set of non-transitory computer executable instructions comprises an algorithm for the pixel-by-pixel analysis of the first image and/or the second image. Example embodiments of such algorithms are described above.

In some embodiments, apparatus 50 further comprises print engine 56 and fixation module 58. Print engine 56 is operatively arranged to receive print media 52 and to apply a first material, e.g., toner 62, to first surface 64 of print media 52 and to apply a second material, e.g., toner 80, to second surface 82 of print media 52 subsequent to fixing first material 62 to first surface 64 of print media 52. Fixation module 58 comprises full width array 66, is arranged subsequently to print engine 56 in process direction 54, and is operatively arranged to receive print media 52 with first material 62 applied to first surface 64 of print media 52 and/or second material 80 applied to second surface 82 of print media 52. In some embodiments, apparatus 50 further comprises duplexing path 84 arranged subsequently to fixation module 58 and before decurling module 60.

Broadly, the present disclosure includes some embodiments of methods for decurling a print media. In some embodiments, the method comprises: applying a first material, e.g., toner 62, on first surface 64 of print media 52; obtaining a first image of first surface 64 of print media 52 using full width array 66; analyzing on a pixel-by-pixel basis the first image to determine a magnitude of first curl 78 in first direction 76 of print media 52; and, applying first force 74 in first direction 76 via first actuator 72 to first roller 68 proportional to the magnitude of first curl 78.

In some embodiments, the method for decurling print media further comprising: applying a second material, e.g., toner 80, on second surface 82 of print media 52; obtaining a second image of second surface 82 of print media 52 using full width array 66; analyzing on a pixel-by-pixel basis the second image to determine a magnitude of second curl 96 in second direction 94 of print media 52; and, applying second force 92 in second direction 94 via second actuator 90 to second roller 86 proportional to the magnitude of second curl 96.

In some embodiments, as described above, the system and apparatus for decurling a print media includes duplex path 84. In such embodiments, the step of applying first force 74 and/or second force 92 occurs after print media 52 passes duplexing path 84.

Pixel-by-Pixel Analysis

The following is an example embodiment of a suitable pixel-by-pixel analysis for use with the presently disclosed system and apparatus. Of course, this embodiment is only one option for performing such an analysis and other algorithms may be used, which algorithms fall within the scope of the claims below.

It has been found that the color intensity, in RGB space, can be correlated to the amount of toner fused on a sheet of print media by a xerographic process. In short, the locations of pixels with RGB values different than a baseline, i.e., blank sheet, determines the location of toner on the sheet of print media. A baseline calibration of the sensor, e.g., full width array, is performed by scanning a blank sheet of print media thereby acquiring baseline values for that particular type of print media. The baseline calibration makes the present method robust in that various optical properties of print media can be accommodated, e.g., brightness, color, opacity and gloss. Subsequently, an RGB to pixel correlation calibration can be performed to determine a transfer function for RGB to pixel by reading full page halftones.

In some embodiments, surface 64 of sheet of print media 52 is divided into zones, e.g., zones 1-1, 1-2, 1-3, 1-4, 1-5, 1-6, 1-7, 1-8 and 1-9. Zones 1-1, 1-2 and 1-3 are arranged along inboard edge IB, zones 1-7, 1-8 and 1-9 are arranged along outboard edge OB, zones 1-3, 1-6 and 1-9 are arranged along lead edge LE, zones 1-1, 1-4 and 1-7 are arranged along trail end TE, and zone 1-5 is arranged in central portion CP, all of which edges and portions collectively form sheet 52. It should be appreciated that although not depicted herein, the second side of media 52, i.e., surface 82, also comprises similar zones. However, for clarity, those zones, if depicted would be referenced as zones 2-1, 2-2, 2-3, 2-4, 2-5, 2-6, 2-7, 2-8 and 2-9. Moreover, each respective zone is further subdivided into pixels, e.g., pixel 102, and each pixel 102 comprises a pixel location i,j, i.e., i is the location in the process direction and j is the location in the cross process direction. Prior to any deposition of toner or other material, sheet 52 is scanned to provide a baseline value for each pixel within each zone. Color values are recorded for the baseline scan. It should be appreciated that the presently disclosed algorithm could use different color spaces depending upon the in-line spectrophotometer output, e.g., full width array output. For example, the color space could be (R,G,B), sRGB, (H,S,L), (H,S,V), etc. An average color value throughout the entire sheet is obtained and stored. The following equation may be used to represent the average color value:

$$\mathrm{AVG}\Sigma_{i=1,j=1}^{i=n,j=m}(R_{ij},G_{ij},B_{ij})=(R_{baseline},G_{baseline},B_{baseline})$$

wherein: i=pixel location in the process direction, i.e., direction 54 j=pixel location in the cross-process direction, i.e., direction 104 n=total number of pixels in process direction m=total number of pixels in cross-process direction Subsequently, an image is printed on a sheet of print media having the same baseline characteristics as sheet 52. Then, the printed image is scanned to gather data for use in determining whether curl is present within the sheet of media including the printed image. The following equation can be used to calculate a pixel count:

$$\text{Pixel Count}_{i,j}=\Sigma_{i=1,j=1}^{i=n,j=m}[(R_{ij}-R_{baseline})+(G_{ij}-G_{baseline})+(B_{ij}+B_{baseline})]$$

wherein: i=pixel location in the process direction, i.e., direction 54 j=pixel location in the cross-process direction, i.e., direction 104 n=total number of pixels in process direction m=total number of pixels in cross-process direction x,y=the relevant zone y on side x of sheet 52

The foregoing Pixel Count determined for each zone on sheet 52 may be used in the following decurler equation:

$$\text{Decurler Indentation}_x=A_1(\text{Pixel Count}_{x,1})+A_2(\text{Pixel Count}_{x,2})\ldots A_9(\text{Pixel Count}_{x,9})+OF$$

wherein: $A_k$=weight coefficient for location k on sheet 52

Pixel $\text{Count}_{x,k}$=pixel count for location k on side x of sheet 52

OF=other factors and interactions, e.g., paper weight, pixel count, grain direction, etc.

It is believed that coefficients $A_k$ for the corner locations of sheet 52, i.e., 1-1, 1-3, 1-7 and 1-9, will have more weight than the edge locations of sheet 52, i.e., 1-2, 1-4, 1-6 and 1-8, while the middle location of sheet 52, i.e., 1-5, will have the lowest $A_k$ value.

As some detectors/sensors measure red, green, blue and monochrome colors, and most printers print in cyan (C), magenta (M), yellow (Y) and black (K), the foregoing pixel count may need to be converted to an alternate colorspace before the measured data can be useful, e.g., the CMYK colorspace. In such instances, the pixel count may be calculated using alternate methods. For example, pixel count may also be calculated using the following transfer functions:

$$\text{Pixels_}C_{i,j}=G\text{_Value}_{i,j}+B\text{_Value}_{i,j}$$

$$\text{Pixels_}M_{i,j}=R\text{_Value}_{i,j}+B\text{_Value}_{i,j}$$

$$\text{Pixels_}Y_{i,j}=R\text{_Value}_{i,j}+G\text{_Value}_{i,j}$$

$$\text{Pixels_}K_{i,j}=R\text{_Value}_{i,j}+G\text{_Value}_{i,j}+B\text{_Value}_{i,j}$$

wherein: i=pixel location in the process direction, i.e., direction 54 j=pixel location in the cross-process direction, i.e., direction 104

Pixels_$C_{i,j}$=pixel count for cyan at location i,j of sheet 52

Pixels_$M_{i,j}$=pixel count for magenta at location i,j of sheet 52

Pixels_$K_{i,j}$=pixel count for yellow at location i,j of sheet 52

Pixels_$K_{i,j}$=pixel count for black at location i,j of sheet 52

$\text{R_Value}_{i,j}=R_{i,j}-R_{baseline}$ $\text{G_Value}_{i,j}=G_{i,j}-G_{baseline}$ $\text{B_Value}_{i,j}=B_{i,j}-B_{baseline}$ $R_{i,j}$=pixel count for red at location i,j of sheet 52

$G_{i,j}$=pixel count for green at location i,j of sheet 52

$B_{i,j}$=pixel count for blue at location i,j of sheet 52

$R_{baseline}$=average value of pixel count for red at all locations i,j of sheet 52 having no printed material thereon $G_{baseline}$=average value of pixel count for green at all locations i,j of sheet 52 having no printed material thereon $B_{baseline}$=average value of pixel count for blue at all locations i,j of sheet 52 having no printed material thereon In this example, a value or pixel count for each color, i.e., cyan, magenta, yellow and black, is calculated for each pixel of sheet 52. First a baseline value for each color at each pixel is calculated, i.e., values obtained for a sheet of media having no printed material thereon, and then that baseline is subtracted from each pixel location value to obtain a pixel count for that particular color at a specific pixel location, e.g., a cyan pixel count for pixel i,j of sheet 52.

In view of the foregoing, it should be appreciated that a full width array sensor output provides toner location and pixel information to the print engine. By evaluating the tones of each individual pixel in an image, the print engine can differentiate between imaged and non-imaged regions of the sheet. The color intensity, in the RGB space, can be correlated to the amount of toner fused on the sheet by xerographic process, also referred to as the pixel value. The location of pixels with RGB values different than a baseline, i.e., blank sheet, determines the location of toner on a sheet of print media.

It should be appreciated that the present disclosure also sets forth a fuser or dryer module that is separated from the image transfer zone by some distance. Fuser 58 is offset from photoreceptor belt 106 whereby an image is transferred from photoreceptor belt 106 to media 52, media 52 is transported past all contact with photoreceptor belt 106, and subsequently passes through fuser 58 wherein the transferred image is fixed to media 52. In other terms, media 52 comprises process direction length 108, fuser 58 is offset by distance 110 from the final portion of the image transfer zone of photoreceptor belt 106, and distance 110 is greater than process direction length 108. It should be appreciated that the separation of fuser 58 and photoreceptor belt 106 is beneficial to image quality as it avoids image artifacts or defects caused by minute differences in roller velocities between photoreceptor belt 106 and fuser 58, e.g., banding.

Moreover, it should be further appreciated that although the above disclosure is primarily directed to devices using a dry marking material and a fuser, the present disclosure also includes devices using liquid marking material and a dryer. Thus, in some embodiments, printer 112 is used to produce print media 114 moving in process direction 116. Printer 112 comprises print engine 118, dryer 120, full width array 122 and duplexing path 124. Print engine 118 is operatively arranged to receive print media 114 and to apply first liquid marking material 126 to first surface 128 of print media 114. Dryer 120 is arranged subsequently to print engine 118 in process direction 116 and is operatively arranged to receive print media 114 with first liquid marking material 126 applied to first surface 128 of print media 114 and to fix first liquid marking material 126 on first surface 128 using at least one of heat and pressure. Full width array 122 is arranged subsequently to dryer 120 and is operatively arranged to obtain a first image of first surface 128 of print media 114, where the first image is used to quantify a flatness of print media 114 and/or image quality of the first image. Duplexing path 124 is arranged subsequently to full width array 122. Similar to some embodiments described above, media 114 comprises process direction length 130, while printer 112 comprises distance 132 between print engine 118 and dryer 120. Distance 130 is greater than process direction length 130.

It should be further appreciated that although a photoreceptor belt is depicted in the various figures related to the transfer of dry marking materials, other types of dry marking material transfer are equally relevant. For example, the present system may include a non-photosensitive image transfer means such as a know transfer belt or roller. These types of variations of the present system, as well as others, fall within the scope of the claims The present disclosure sets forth the use of an inline full width array scanning module, i.e., sensor module, to measure the spatial distribution of an imaged area on a sheet of print media and subsequent use of this distribution as a control input to a downstream media decurling device. It has been found that the density and distribution of an imaged area on a sheet will affect media curl, i.e., an image with a heavy inboard and/or outboard border will curl more than an image with a light or no border. The present system comprises a scan module mounted between a printer's fuser, dryer or fixation module and decurling module. The present system uses a transfer function relating image density per unit area to media curl, and the decurling module is adjusted in real time based on the results of the scanned image and output of the transfer function. The present system allows adjustment of the decurling module to compensate for both sheet to sheet curl and within sheet curl. The present system, apparatus and method provide the ability to actively control media decurling based on image content.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A printer for producing a print media moving in a process direction, comprising:

a print engine operatively arranged to receive the print media and to apply a first dry marking material to a first surface of the print media;

a fuser arranged subsequently to the print engine in the process direction and operatively arranged to receive the print media with the first dry marking material applied to the first surface of the print media and to fix the first dry marking material on the first surface using at least one of heat and pressure;

a full width array arranged subsequently to the fuser and operatively arranged to obtain a first image of the first surface of the print media, the first image being used to quantify a flatness of the print media; and, a decurling module comprising:

a first roller;

a second roller arranged opposite the first roller; and, a first actuator;

wherein the first actuator imparts a first force on the first roller in a first direction towards the second roller when the first image indicates a first curl in the first direction, and a magnitude of the first force is determined based on the flatness of the print media.

2. The printer for producing a print media of claim 1, wherein the magnitude of the first force is determined by a pixel-by-pixel analysis of the first image.

3. The printer for producing a print media of claim 1, wherein the print engine is operatively arranged to apply a second dry marking material to a second surface of the print media opposite the first surface subsequent to fixing the first dry marking material to the first surface of the print media.

4. The printer for producing a print media of claim 1, further comprising a duplexing path arranged subsequently to the full width array and before the decurling module.

5. The printer for producing a print media of claim 1, wherein the fuser is arranged to receive the print media with a second dry marking material applied to a second surface of the print media opposite the first surface.

6. The printer for producing a print media of claim 1, wherein the full width array is operatively arranged to obtain a second image of a second surface of the print media opposite the first surface.

7. The printer for producing a print media of claim 6, wherein the magnitude of the first force is determined by a pixel-by-pixel analysis of the first image and/or the second image.

8. The printer for producing a print media of claim 1, wherein the decurling module further comprises:

a third roller;

a fourth roller arranged opposite the third roller; and, a second actuator;

wherein the second actuator imparts a second force on the third roller in a second direction opposite the first direction and towards the fourth roller when the first image indicates a second curl in the second direction, and a magnitude of the second force is determined based on the flatness of the print media.

9. The printer for producing a print media of claim 8, wherein the magnitude of the second force is determined by a pixel-by-pixel analysis of the first image.

10. The printer for producing a print media of claim 8, wherein the full width array is operatively arranged to obtain a second image of a second surface of the print media opposite the first surface.

11. The printer for producing a print media of claim 10, wherein the magnitude of the first force and the magnitude of the second force are determined by a pixel-by-pixel analysis of the first image and/or the second image.

12. The printer for producing a print media of claim 10, further comprising:

a memory element arranged to store a set of non-transitory computer executable instructions, the first image, and the second image; and, a processor operatively arranged to execute the set of non-transitory computer executable instructions;

wherein the set of non-transitory computer executable instructions comprises an algorithm for a pixel-by-pixel analysis of the first image and/or the second image.

13. The printer for producing a print media of claim 1, further comprising:

a memory element arranged to store a set of non-transitory computer executable instructions and the first image; and, a processor operatively arranged to execute the set of non-transitory computer executable instructions;

wherein the set of non-transitory computer executable instructions comprises an algorithm for a pixel-by-pixel analysis of the first image.

14. A printer for producing a print media moving in a process direction, comprising:

a print engine operatively arranged to receive the print media and to apply a first liquid marking material to a first surface of the print media;

a dryer arranged subsequently to the print engine in the process direction and operatively arranged to receive the print media with the first liquid marking material applied to the first surface of the print media and to fix the first material on the first surface using at least one of heat and pressure;

a full width array arranged subsequently to the dryer and operatively arranged to obtain a first image of the first surface of the print media, the first image being used to quantify a flatness of the print media; and, a decurling module comprising:

a first roller;

a second roller arranged opposite the first roller; and, a first actuator;

wherein the first actuator imparts a first force on the first roller in a first direction towards the second roller when the first image indicates a first curl in the first direction, and a magnitude of the first force is determined based on the flatness of the print media.

15. The printer for producing a print media of claim 14, wherein the magnitude of the first force is determined by a pixel-by-pixel analysis of the first image.

16. The printer for producing a print media of claim 14, wherein the print engine is operatively arranged to apply a second liquid marking material to a second surface of the print media opposite the first surface subsequent to fixing the first liquid marking material to the first surface of the print media.

17. The printer for producing a print media of claim 14, further comprising a duplexing path arranged subsequently to the full width array and before the decurling module.

18. The printer for producing a print media of claim 14, wherein the dryer is arranged to receive the print media with a second liquid marking material applied to a second surface of the print media opposite the first surface.

19. The printer for producing a print media of claim 14, wherein the full width array is operatively arranged to obtain a second image of a second surface of the print media opposite the first surface.

20. The printer for producing a print media of claim 19, wherein the magnitude of the first force is determined by a pixel-by-pixel analysis of the first image and/or the second image.

21. The printer for producing a print media of claim 14, wherein the decurling module further comprises:

a third roller;

a fourth roller arranged opposite the third roller; and, a second actuator;

wherein the second actuator imparts a second force on the third roller in a second direction opposite the first direction and towards the fourth roller when the first image indicates a second curl in the second direction, and a magnitude of the second force is determined based on the flatness of the print media.

22. The printer for producing a print media of claim 21, wherein the magnitude of the second force is determined by a pixel-by-pixel analysis of the first image.

23. The printer for producing a print media of claim 21, wherein the full width array is operatively arranged to obtain a second image of a second surface of the print media opposite the first surface.

24. The printer for producing a print media of claim 23, wherein the magnitude of the first force and the magnitude of the second force are determined by a pixel-by-pixel analysis of the first image and/or the second image.

25. The printer for producing a print media of claim 23, further comprising:

a memory element arranged to store a set of non-transitory computer executable instructions, the first image, and the second image; and, a processor operatively arranged to execute the set of non-transitory computer executable instructions;

wherein the set of non-transitory computer executable instructions comprises an algorithm for a pixel-by-pixel analysis of the first image and/or the second image.

26. The printer for producing a print media of claim 14, further comprising:

a memory element arranged to store a set of non-transitory computer executable instructions and the first image; and, a processor operatively arranged to execute the set of non-transitory computer executable instructions;

wherein the set of non-transitory computer executable instructions comprises an algorithm for a pixel-by-pixel analysis of the first image.

27. A method for decurling a print media having a first marking material on a first surface as the print media moves through a printer in a process direction, the method comprising:

obtaining a first image of the first surface of the print media using a full width array arranged after a fixation module and before a duplex path relative to the process direction;

analyzing on a pixel-by-pixel basis the first image to determine a magnitude of a first curl in a first direction of the print media; and, applying a first force in the first direction via a first actuator to a first roller towards a second roller proportional to the magnitude of the first curl.

28. The method for decurling a print media of claim 27, wherein the print media further comprises a second marking material on a second surface, the method further comprising:

obtaining a second image of the second surface of the print media using the full width array;

analyzing on a pixel-by-pixel basis the second image to determine a magnitude of a second curl in a second direction of the print media; and, applying a second force in the second direction via a second actuator to a third roller towards a fourth roller proportional to the magnitude of the first curl and/or the second curl.

29. The method for decurling a print media of claim 28, wherein the steps of applying the first force and/or the second force occur after the print media passes the duplex path.

30. The method for decurling a print media of claim 28, wherein the first marking material and the second marking material are a dry marking material or a liquid marking material.

31. The method for decurling a print media of claim 27, wherein the step of applying the first force occurs after the print media passes the duplex path.

32. The method for decurling a print media of claim 27, wherein the fixation module is a fuser or a dryer.

33. The method for decurling a print media of claim 27, wherein the first marking material is a dry marking material or a liquid marking material.

* * * * *